US007093315B2

(12) United States Patent
Cavalheiro

(10) Patent No.: US 7,093,315 B2
(45) Date of Patent: Aug. 22, 2006

(54) TWIST MOP

(75) Inventor: Flavio Cavalheiro, Blauvelt, NY (US)

(73) Assignee: Kaminstein Imports, Inc., Blauvelt, NY (US)

( * ) Notice: Subject to any disclaimer, the term of this patent is extended or adjusted under 35 U.S.C. 154(b) by 66 days.

(21) Appl. No.: 10/630,117

(22) Filed: Jul. 30, 2003

(65) Prior Publication Data

US 2005/0022327 A1 Feb. 3, 2005

(51) Int. Cl.
*A47L 13/142* (2006.01)

(52) U.S. Cl. ..... 15/120.2; 15/120.1

(58) Field of Classification Search ..... 15/120.1, 15/120.2

See application file for complete search history.

(56) References Cited

U.S. PATENT DOCUMENTS 1,514,051 A * 11/1924 Jumonville ..... 15/120.2
1,520,500 A * 12/1924 Jumonville ..... 15/120.2
5,509,163 A * 4/1996 Morad ..... 15/120.2
6,212,728 B1 * 4/2001 Facca et al. ..... 15/120.2
6,732,396 B1 * 5/2004 Laux et al. ..... 15/120.2
2004/0006836 A1 * 1/2004 Dingert ..... 15/120.1
2004/0128783 A1 * 7/2004 Lesley et al. ..... 15/120.1

* cited by examiner

*Primary Examiner*—Mark Spisich
(74) *Attorney, Agent, or Firm*—Stephen E. Feldman, P.C.

(57) ABSTRACT

A twist mop comprises a pole, fibers connected to the pole, and a movable collar connected to both the fibers and the pole, so that the collar is movable in an axial and radial direction about the pole, where radial movement of the collar pulls taut the fibers. The mop comprises an upper spline is connected to the pole, a pawl connected to the collar, to allow the collar to move in a radial direction clockwise or counterclockwise about the upper spline. The collar has a radial step to engage the pawl. The pawl is shaped to flex toward the radial step both when the collar axially traverses the pole and when the collar twists in a first direction, around the upper spline. The pawl being shaped to bias towards the upper spline while the collar turns in a second direction, opposite to the first direction, around the upper spline.

13 Claims, 7 Drawing Sheets

TWIST MOP

FIELD OF THE INVENTION

The invention relates to the field of cleaning supplies, and more specifically to a mop and system for wringing the fibers of the mop.

BACKGROUND

In the field of cleaning it is well known that cleaning floors is often difficult to accomplish while conserving water and detergents, while also insuring that the subject floor adequately cleaned. Typically, floors are mopped using various types of conventional mop heads, the mop head being immersed in a volume of water and soap. Several gallons of water and a proportional amount of detergent are used to clean the floor. After the mop is immersed into the water and detergent, a portion of the liquid is squeezed from the mop head and the mop is then wiped across the floor to be cleaned. This leaves the floor wet for a period of time. After the mop head becomes soiled, or after the cleaning fluids have been used up, the mop head needs to be rinsed in the volume of water and detergent, and the process is repeated.

Wringer mops are well known in the art for augmenting the experience of rinsing the mop head. In some types of wringer mops, two operating rods on the exterior of the mop handle are used to pull the mop head through sets of wringer rollers to expel fluid from the sponge of the mop head. In other types of wringer mops, a single operating rod extends through the hollow handle of the mop to connect to the mop head. These types of mops generally include a ring insert placed within the handle to limit lateral movement of the rod within the handle. These mops have the problem in that they have a complicated design and, accordingly, are more fragile to use.

One example of a prior art mop, U.S. Pat. No. 6,212,728 to Facca, discloses a self-wringing ratchet mop. The '728 patent discloses a wall defining at least one pawl. Another example of a prior art mop, U.S. Pat. No. 6,115,869, to Libman, discloses a wringer mop. The '869 patent discloses a pawl on a ring that is resiliently fixed the handle, and a series of elongated ribs (spline) on a movable collar.

A problem with the arrangements of the above patents is that the pawl projections are incapable of flexing with the movement of the collar over the handle. Over time, the pawl projections suffer extensive shearing and are rendered useless.

Another example of a prior art mop, U.S. Pat. No. 5,509,163, to Morad, discloses a Quick Squeezing Wringable Mop. The '163 patent discloses a complex spring biased pawl, and an annular tie for connecting mop fibers to the collar. The complexity of the spring biased pawl and the intricate mounting of the pawl to the collar adversely affects manufacturing cost and time. The annual ties are brittle and have poor restraining qualities, causing the loss of necessary mop fibers.

Other examples of prior art mops include U.S. Pat. Nos. 1,514,051 and 1,520,500 to Jumonville, each disclosing a Mop. The patents teach a pole that holds one end of mop fibers and a handle that holds the other end of the mop fibers. The patents teach turning the handle about the pole to twist and wring the mop fibers.

The patents disclose a ratchet on the pole and a cylindrical button on the handle. The button is located within a slot. The slot has enough room to allow the button to move towards and away from the ratchet. When the button engages a peak in the ratchet contour, the button is pushed outwardly, away from the ratchet. Otherwise, the button is supposed to bias towards the ratchet so that the button and handle are allowed to advance in a singular direction. Accordingly, the mop fibers advance in a single direction to assist in the wringing process.

The 500' patent discloses a nail for controlling the maximum motion of the button in the handle. The 051' patent discloses manufacturing the button so that the inward portion has a lager diameter than the outer portion, thereby controlling the maximum motion of the button.

Both Jumonville inventions suffer from a fatal defect. Both inventions are disclosed as being made of metal. Accordingly, the metal button of both patents would move freely within the slot of the metal handle, unless biased by some means. However, neither patent discloses this bias means.

According to the disclosure of each Jumonville patent, the button in each handle would freely move outwardly from contacting the ratchet. This motion renders the handle incapable of being restrained from unintentionally unwinding the mop fibers. This motion would result from both of the contours of the ratchet, and the effect of gravity due to the normal use of the mop. Accordingly, both Jumonville patents are not described so that one skilled in the art can make and use the invention, and the patents are fatally invalid.

In comparison with the Jumonville patents, the present invention discloses a spline around the pole of the mop, rather than the ratchet of Jumonville. The present invention discloses a shaped pawl within the handle, rather than the cylindrical button. In the present invention, the pawl snuggly connects the pole of the handle, rather than fitting within a slot and being able to move towards and away from the spline.

The pawl flexes as it moves over the maximum spline contours, rather than moving away from the spline. As the pawl flexes, it absorbs energy. As the pawl rotationally advances over the spline, it advances towards lower contours. At the lower contours, the pawl flexes inwardly, towards the lower contours, and releases the stored energy, rather than requiring a means to bias the pawl against the spline. Accordingly, the pawl and handle are allowed to advance in a singular direction. As a result, the mop fibers advance in a single direction to assist in the wringing process.

According to the above analysis, Jumonville is not an enabling reference over the present invention. Furthermore, Jumonville teaches away from the present invention by requiring an extra means for biasing the button against the ratchet. In contrast, the pawl and spline in the present invention are capable of mutual engagement independent of any further biasing means.

SUMMARY OF THE INVENTION

A twist mop is discloses that comprises a pole, fibers connected to the end of the pole, and a movable collar connected to both the fibers and the pole, so that the collar is movable in an axial and radial direction about the pole, where radial movement of the collar pulls taut the fibers. The mop comprises an upper spline is connected to the pole, a pawl connected to the collar, to interact with the upper spline and to allow the collar to move in a radial direction clockwise or counterclockwise. The collar has a radial step to engage the pawl. The pawl is shaped to flex toward the radial step both when the collar axially traverses the pole and when the collar twists in a first direction, around the upper spline. The pawl being shaped to bias towards the upper spline while the collar turns in a second direction, opposite to the first direction, around the upper spline. Accordingly, a reliable and easy to use, and structurally straightforward wringer mop is disclosed.

DESCRIPTION OF THE DRAWINGS

In order that the manner in which the above recited objectives are realized, a particular description of the invention will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which.

DETAILED DESCRIPTION

Figure 1A:
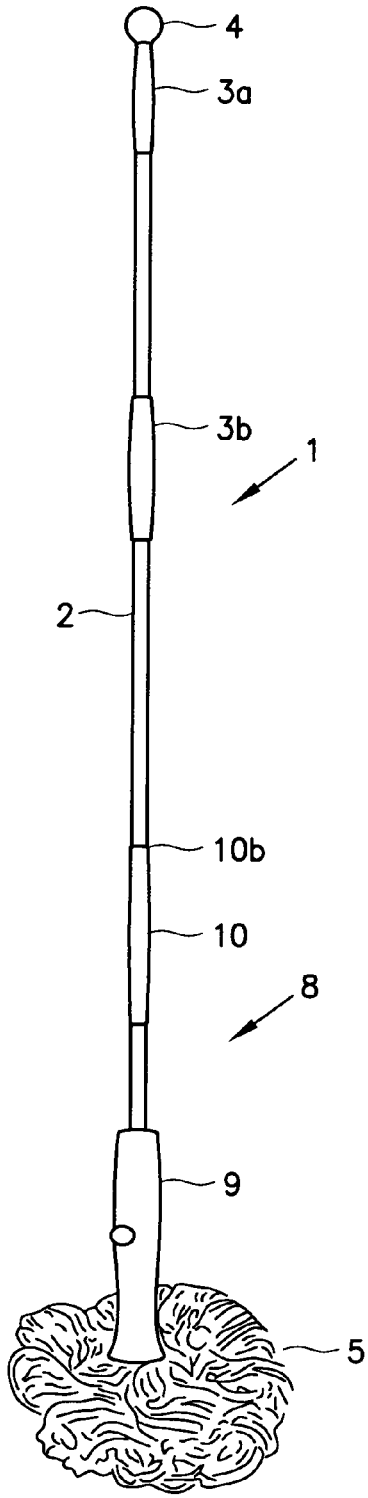
FIG. 1*a* is a front perspective view of a mop according to the invention with a movable collar in a lower position.

Referring to FIGS. 1*a*, 1*b*, 5*a*, 5*b*, 9 and 10, a twist mop 1 is disclosed according to the preferred embodiment of the invention. The principle components of twist mop 1 include pole 2 and components connected to the pole, such as handles 3*a*, 3*b*, a hook 4, and fibers 5. Mop 1 has a collar 9 that is connected to fibers 5 and able to rotate and slide along a length of pole 2. The combined rotation and sliding motion of collar 9 pulls fibers 5 taut.

According to the invention, a spline 10 is fixed to pole 2, while a pawl 12 is connected to collar 9. These components form a system for controlling the motion of collar 9 about pole 1. The system is capable of assisting collar 9 in pulling fibers 5 taut.

Referring to FIG. 1*a*, mop 1 is disclosed having pole 2, the preferred length of which is slightly shorter than a person of average height for preventing back strain and is about four feet long. The outside diameter of pole 2 dimensioned to be comfortable in handling by a person having an average grip and is about thirteen-sixteenths of an inch. Tubular or solid metal, plastic, wood, or composite materials are used in manufacturing pole 2.

Mop 1 has top handle 3*a* and middle handle 3*b*, each connected by a bolt or, alternatively, glue. Plastic, rubber, or any elastic that provides a comfortable grip is used in manufacturing handles 3*a*, 3*b*. The dimensions of handles 3*a*, 3*b* are customary for providing a comfortable grip, where the length of handle 3*a* is four and a half inches, the length of handle 3*b* is six inches, and the diameter of each is approximately one-and-one-eighth inches. Handle 3*b* is axially positioned on pole 2 to prevent back strain from a person of average height and is located at about twelve inches from the top of pole 2.

Handle 3*a* has hook 4 so that mop 1 can be easily stored on a wall or door hook. The outside diameter of hook 4 is about one-and-one-half inches, and the thickness is approximately one-quarter of an inch.

Figure 2:
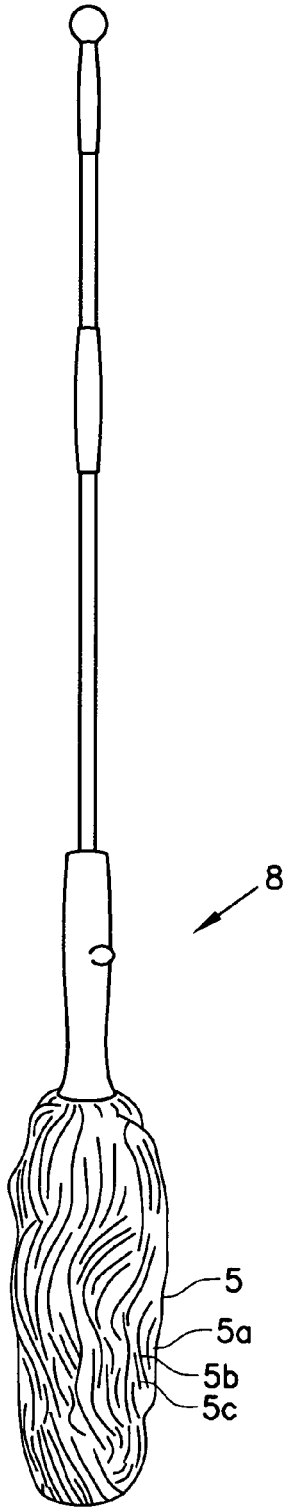
FIG. 2 is a front perspective view of the mop with the movable collar in an upper position.

Turning to FIG. 2, mop 1 has fibers 5 that are made of cotton or any absorbent material. The diameter of fibers 5 is customarily about three-sixteenths of an inch. Fibers are woven to mop 1 as a single strand and passed through end cap 6 (discussed below) and collar 9 (discussed below). The single fiber strand is illustrated as being woven into one hundred or more fiber segments 5*a*, 5*b*, etc, each extending a length that allows for mopping as well as wringing, such as about sixteen inches.

Figure 3:
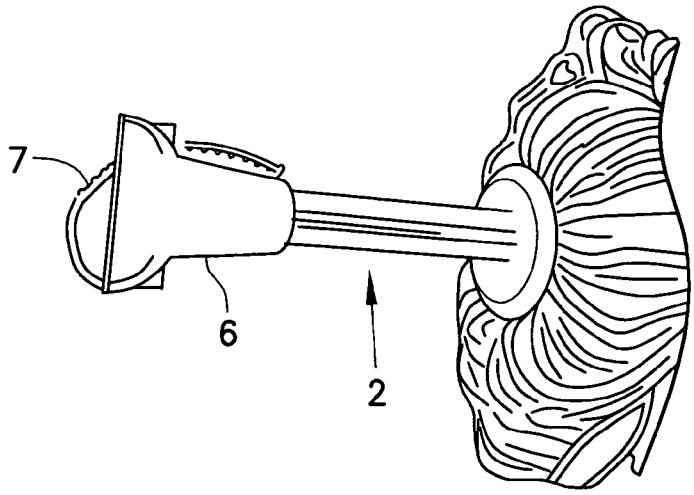
FIG. 3 is a front perspective view of the mop, with the mop fibers removed to expose the lower section of the mop.

Turning to FIG. 3, mop 1 has end cap 6 that is semi-circular and mounted to pole 2 with screw thread, bolts or glue. The shape and dimensions of cap 6 allow the secure retention of fiber segment 5*a*, 5*b*, etc, and the cap has an outside diameter of about two and seven-sixteenths inches with a thickness of three-thirty-seconds of an inch. A retainer strip 7 is connected to cap 6 for restraining each fiber segment 5*a*, 5*b*, 5*c*, etc.

Referring to FIGS. 1*b* and 4–10, mop 1 has a system for wringing and controlling mop fibers 5, including movable collar 9, upper spline 10, lower spline 11, and pawl 12.

Figure 1B:
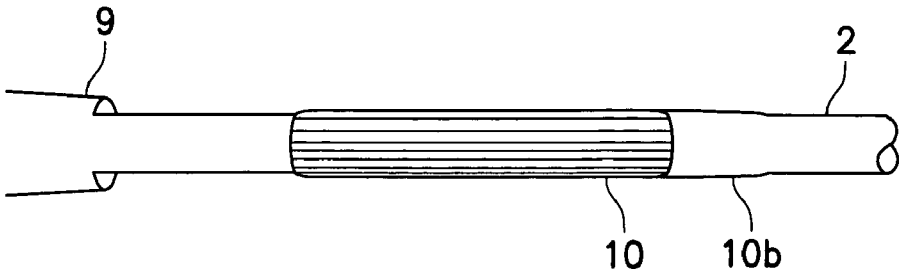
FIG. 1*b* is a front perspective view of an upper spline on the mop.
Figure 4:
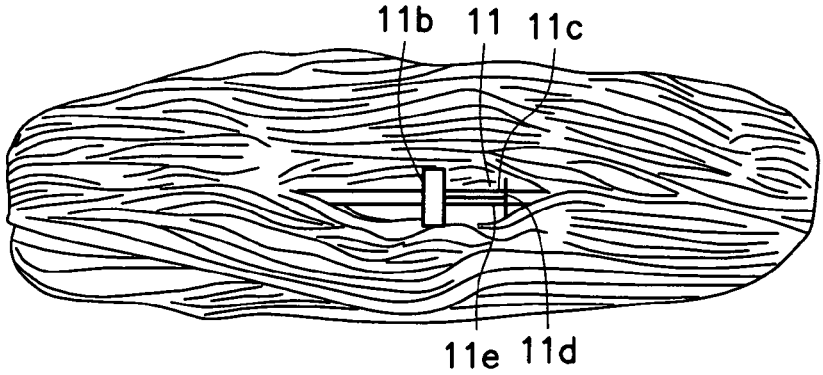
FIG. 4 is a front perspective view of the mop fibers, with the collar is in the upper position, exposing the lower spline.

Referring to FIGS 1*b* and 4, upper spline 10 is formed upon upper stationary collar 10*b* and lower spline 11 is formed upon lower stationary collar 11*b*. Upper spline 10 consists of axially long projections 10*c*, 10*d*, 10*e*, and lower spline 11 consists of axially short projections 11*c*, 11*d*, 11*e*. Each spline 10, 11 is connected to pole 1 with a bolt or glue. Plastic is used to manufacture collars 10*b*, 11*b* and spline 10, 11.

Figure 9:
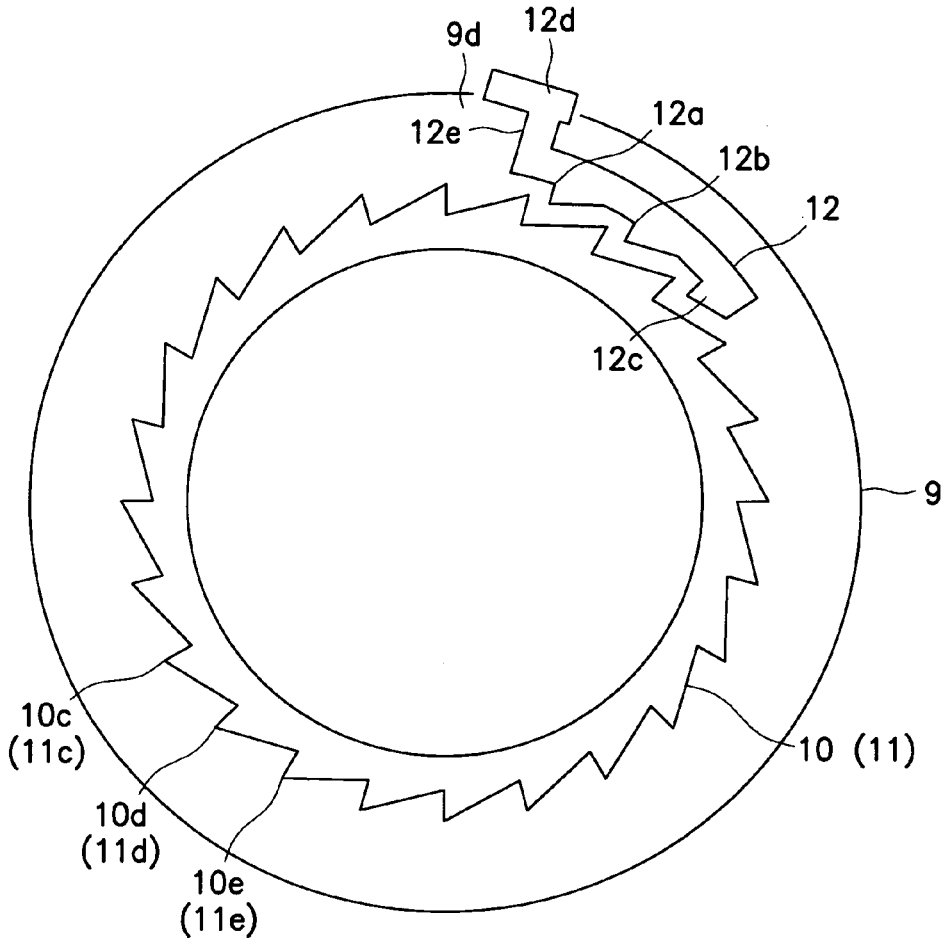
FIG. 9 is a top sectional view of the upper spline (or lower spline) interacting with pawl.

Referring to FIG. 9, the cross-sectional shape of spline 10, 11 is essentially constant along the axial length of pole 2, being a right triangle with an inclined side. The inclined side faces the direction that movable collar 9 turns when wringing mop fibers 5. In the illustration of FIG. 9, collar 9 turns in a counterclockwise direction for wringing fibers 5. Accordingly, the inclined side of spline projections 10 faces the counterclockwise direction. The height of individual spline projections 10, 11 is designed for interacting with movable collar 9. As illustrated, each has a height that is about one-eighth of an inch and the outside diameter of splines 10, 11 is about one inch.

Figure 8:
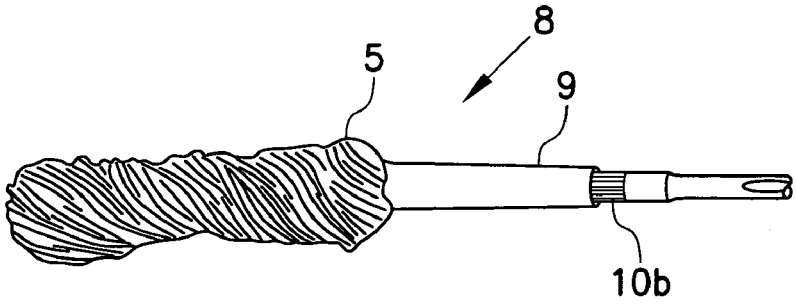
FIG. 8 is a front perspective view of the mop, where the movable collar is twisted for wringing the mop fibers.

Referring to FIGS. 1*a*, 4 and 8, the placement of collars 10*b*, 11*b* creates a separation that allows for free rotation of collar 9 for the unwinding of fibers 5. The top of collar 10*b* is about twenty one and three-quarter inches from the bottom of pole 2, while the top of collar 11*b* is about seven and one-quarter inches from the bottom of pole 2.

Figure 6:
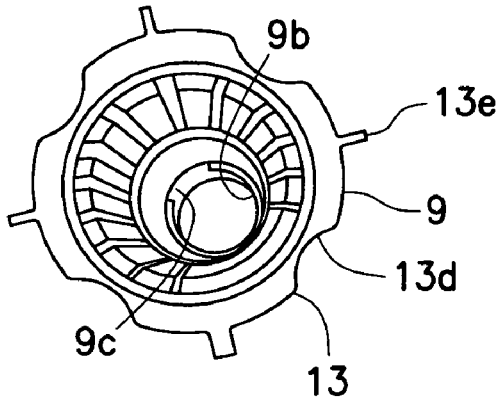
FIG. 6 is a bottom perspective view of the movable collar.
Figure 7:
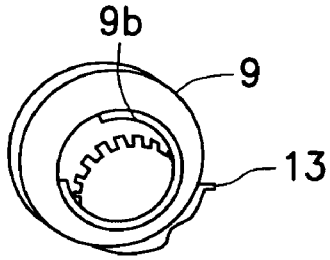
FIG. 7 is a top perspective view of the movable collar.

Referring to FIGS. 1*a* and 2, and 5*a*–5*b*, movable collar 9 has external contours and a diameter that provides a comfortable grip in a person's hand. Referring to FIGS. 6 and 7, the internal diameter of collar 9 is larger than the outer diameter of spline 10, 11. The collar has a bottom section 13 with notches 13*a*, 13*b*, 13*c*, etc, contours 13*d* and spline 13*e*. The combination of notches, contours and spline 13*a*–13*e* enables the gripping of fiber segments 5*a*, 5*b*, 5*c*, etc. Notch 13*a*–13*c* are dimensioned to grip fiber segments 5*a*, 5*b*, 5*c*, and for example, have width that is one-eighth of an inch and a length that is approximately nine-sixteenths of an inch.

Referring to FIGS. 1*b*, 4 and 8, the length of spline 10 on collar 10*b* accommodates the downward travel of collar 9 and pawl 12, discussed below, while the length of spline 11 on collar 11*b* controls the maximum downward travel for movable collar 9. The length of upper collar 10*b* is about six and three-quarter inches and the length of lower collar 11*b* is about one-and-a-half inches. Also, collars 10*b*, 11*b* are molded without spline 10, 11 to prevent accidental slippage of movable collar 9 from spline 10, 11. As illustrated, approximately the bottom five and a half inches of collar 10*b* are molded with spline 10 and approximately the top one and three-sixteenths inches of collar 11*b* are molded with spline 11.

Referring to FIGS. 6 and 7, movable collar 9 has a cylindrical step 9*b*. Step 9*b* stabilizes the rotational and axial motion of collar 9. The dimensions of step 9*b* are such that step 9*b* interacts with collar 10, where the radial thickness of step 9*b* is about one-eighth of an inch, and the axial thickness is one-eighth of an inch. Step 9*b* is near pawl 12, and the distance between step 9*b* and top of collar 9 is about three and one-half inches. Alternatively, two steps are used, at or near opposite sides of pawl 12.

Figure 5A:
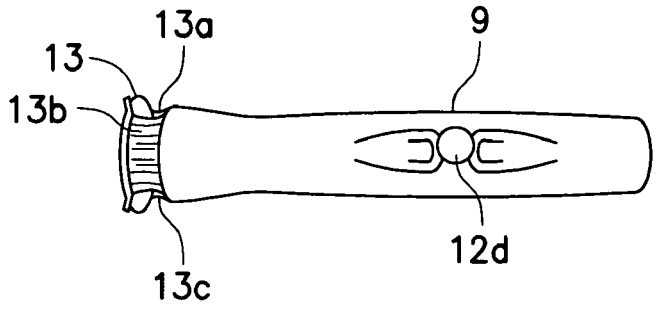
FIG. 5*a* is a front perspective view of the movable collar with the pawl.
Figure 5B:
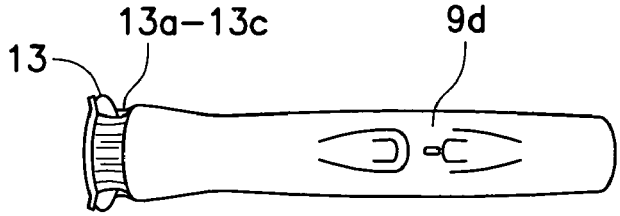
FIG. 5*b* is a front perspective view of the movable collar without the pawl.

Referring to FIGS. 5*a* and 5*b*, and according to the invention, movable collar 9 has slot 9*d*. The dimension of slot 9*d* allows the insertion and retention of pawl 12, such that the width of slot 9*d* is about one-eighth of an inch, and the length is approximately one-half of an inch. Slot 9*d* is located at step 9*b* at, for example, three and one-half inches from the top of collar 9.

Figure 10:
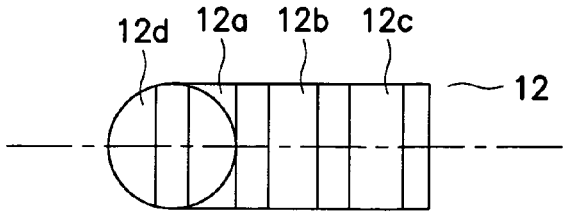
FIG. 10 is a top perspective view of pawl.

Referring to FIG. 5*a*, 9 and 10, pawl 12 connects with movable collar 9. Pawl 12 consists of at least three short projections, 12*a*, 12*b*, 12*c*, base 12*d* and neck 12*e*. Projection 12*a* is sized to prevent pawl 12 from passing through slot 9*d* outwardly from the center of collar 9. The length of neck 12*e* is essentially the same as the thickness of collar 9 in the area of slot 9*d*, preventing axial movement of pawl 12. The size of base 12*d* prevents pawl 12 from passing through slot 9*d*, inwardly towards the center of movable collar 9. The connection between base 12*d* and projection 12*c* places a majority of base 12*d* away from projections 12*a*–12*c*, having benefits as described below.

Referring to FIGS. 9 and 10, the cross-sectional shape of projections 12*a*–12*c*, in a direction parallel to the major axis of collar 9, is essentially a right triangle, having an inclined side. The height of projections 12*a*–12*c* is about one-eighth of an inch. The inclined side of projections 12*a*–12*c* faces opposite to the direction that movable collar 9 turns when wringing mop fibers 5. For illustration purposes, collar 9 turns in a counterclockwise direction for wringing fibers 5. Accordingly, the inclined side of projections 12*a*–12*c* faces the clockwise direction. Accordingly, the interaction between projections 12*a*–12*c* and spline 10 prevents collar 9 from turning clockwise.

According to the invention, the shape of pawl 12 causes projection 12*c* to project toward the center of collar 9, past the inner edge of radial step 9*b*. This configuration allows projections 12*c* to continuously engage spline 10, 11. The radius defined by the tips of projections 12*a*–12*c* is smaller than the radius created by the tips of spline 10, 11. It is to be appreciated that the curve formed by the edge of projections 12*a*–12*c* can be other than radial, so long as projection 12*c* normally projects past the inner edge of radial step 9*b*.

The pawl 12 is made of plastic for flexing behind radial step 9*b* when collar 9 slides over spline 10 prior to and after the wringing of fibers 5 and when collar 9 is rotated for wringing mop fibers 5. This flexing prevents over-straining pawl 12 via shear and compressive friction, preventing premature wearing of spline 10, 11 and pawl 12. The flexure of the plastic is stored as spring-energy in base 12*d*. The release of the energy from base 12*d* biases pawl 12 towards spline 10, 12 to substantially and effectively prevent the unwringing of fibers 5.

In use, when wringing mop fibers 5, movable collar 9 is positioned at a maximum distance from the bottom of pole 2, so that pawl 12 engages upper spline 10 (FIG. 2). Movable collar 9 is then rotated counterclockwise, and pawl 12 prevents collar 9 from rotating clockwise (FIG. 9). Collar 9 is continually rotated until fibers 5 are taut and fully wrung (FIG. 8).

As collar 9 rotates about spline 10, fibers 5 pull collar 9 downwardly (FIG. 8). Once fibers 5 are wrung, collar 9 is moved between upper spline 10 and lower spline 11 and fibers 5 are unwound. Once fibers 5 are unwound, collar 9 is moved to engage lower spline 11 (FIG. 9). During mopping, the interaction between pawl 12 and lower spline 11 prevents axial rotating of movable collar 9.

According to the description, a reliable, easy to use and structurally straightforward twist mop has been disclosed.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

I claim:

1. A twist mop comprising:

a) a pole;

b) fibers connected to the end of the pole;

c) a movable collar connected to both the fibers and the pole, said collar being adapted to traverse the pole in an axial and a radial direction, the collar including lower slots with the fibers being woven into the lower slots, the collar being guided around the pole when the collar is moved about the pole in a radial direction;

d) an upper spline connected to the pole, said upper spline interacting with the collar;

e) a pawl connected to the collar, the pawl being shaped to flex toward the upper spline when said collar axially and radially traverses the pole, the pawl including projections and a base, the projections being inside the collar and the base being outside the collar, the projections connecting to the base so that a majority of the base material is distal from the projections;

f) a middle slot located on the collar for inserting the pawl;

g) a lower spline, the lower spline interacting with the pawl and allowing the collar to move in a radial direction substantially preventing the collar from turning when mopping; and h) an axial area between the upper and lower spline, the axial area having no spline so that the collar may move in any radial direction to un-wring the mop fibers, whereby the fibers are pulled taut when the collar rotates in a first direction around the upper spline and whereby the axial length of the upper spline allows the spline to engage the pawl when the mop fibers are wrung.

2. The mop of claim 1, wherein the upper and lower splines are each on stationary collars, the upper stationary collar having an upper area, the lower stationary collar having a lower area, whereby the upper area and lower area are without a spline to limit the axial motion of the movable collar.

3. The mop of claim 2, further comprising a top handle, a middle handle, and a hook.

4. The mop of claim 3, wherein the top and middle handles are contoured to comfortably engage a hand of a user.

5. A twist mop comprising:

a) an elongated pole;

b) fibers connected to the end of the pole;

c) a movable collar connected to both the fibers and the pole, said collar being adapted to move both along and about the longitudinal axis of the pole, said collar including a slot;

d) an upper spline connected to the pole and adapted to interact with the collar; and e) a pawl connected to the collar and adapted to engage the spline, said pawl comprising an elongate member having a plurality of projections extending from a side thereof, said pawl further including a neck disposed at an end of the elongated member distal to the projections and extending therefrom in a direction opposite that of the projections, the end of the neck spaced from the elongated member including a base, said neck having a length substantially equal to the wall thickness of the collar and extending through the slot in the collar wherein the elongate member and the projections are located in the interior of the collar and the base of the pawl is located outside of the collar, the size of the pawl base being larger than the slot in the collar to prevent the pawl from passing through the slot.

6. The mop of claim 5, wherein the collar comprises lower slots and the mop fibers are woven into the lower slots.

7. The mop of claim 6, wherein the collar is guided around the pole when the collar is moved about the pole in a radial direction.

8. The mop of claim 7, wherein an axial length of the upper spline allows the spline to engage the pawl when the mop fibers are wrung.

9. The mop of claim 8 further comprising a lower spline, the lower spline interacting with the pawl and allowing the collar to move in a radial direction substantially preventing the collar from turning when mopping.

10. The mop of claim 9, further comprising an axial area between the upper and lower spline, the axial area having no spline so that the collar may move in any radial direction to un-wring the mop fibers.

11. The mop of claim 10, wherein the upper and lower splines are each on stationary collars, the upper stationary collar having an upper area, the lower stationary collar having a lower area, whereby the upper area and lower area are without a spline to limit the axial motion of the movable collar.

12. The mop of claim 11, further comprising a top handle, a middle handle, and a hook.

13. The mop of claim 12, wherein the top and middle handles are contoured to comfortably engage a hand of a user.

* * * * *